United States Patent [19]

Martindale

[11] 4,222,323

[45] Sep. 16, 1980

[54] TIRE BUNDLING MACHINE

[75] Inventor: Troy E. Martindale, Reynoldsburg, Ohio

[73] Assignee: The B. F. Goodrich Company, Akron, Ohio

[21] Appl. No.: 30,200

[22] Filed: Apr. 16, 1979

[51] Int. Cl.[3] ..... B65B 13/20

[52] U.S. Cl. ..... 100/12; 100/14; 100/25; 100/99; 100/102; 100/238; 101/228

[58] Field of Search ..... 100/14, 3, 257, 99, 100/12, 25, 238, 102; 101/228

[56] References Cited

U.S. PATENT DOCUMENTS

| | | | |
|---|---|---|---|
| 956,387 | 4/1910 | Magson | 100/99 X |
| 2,883,925 | 4/1959 | Pritchard | 100/12 X |
| 3,129,658 | 4/1964 | Valente | 100/12 X |
| 3,955,491 | 5/1976 | McMahon | 100/12 X |
| 4,006,678 | 2/1977 | Laurie | 100/3 X |

*Primary Examiner*—Billy J. Wilhite
*Attorney, Agent, or Firm*—Joseph Januszkiewicz; Michael J. Colitz, Jr.

[57] ABSTRACT

An automotive tire bundling machine having a support framework or base which supports a pair of vertically spaced tire support members. A stack of tires are placed between the tire support members against guide rods on one of the tire support members. The other tire support member is moveable toward and away from the one tire support member for compressing the stack of tires. A strap feeding means position a strap about the peripheral edges of the stack of tires and is cooperative with a strap clinching device to tension the strap, secure the strap and cut off the excess strap material. The stack of tires is rotatable with the tire support members to facilitate the placement of additional straps about the stack of tires.

10 Claims, 4 Drawing Figures

TIRE BUNDLING MACHINE

BACKGROUND OF THE INVENTION

The present invention relates to a tire bundling machine and more particularly to a new and improved tire bundling apparatus wherein automotive or truck tires are stacked in a vertically disposed stack with their vertical axis being coaxial, containing a predetermined number of tires. The tires are compressed axially and then bundled together into a unitary stack.

The bundling of tires has been done by apparatus which includes an automotive stacker which receives the tires to be stacked from a conveyor means. The tires are stacked at the same level as the conveyor, however, as the tires are placed onto the stacker, means are provided to progressively lower or raise the stack by one tire width to facilitate the reception of another tire. In this apparatus where the stack is lowered progressively each time a tire is added to the stack, it is necessary to provide a pit or some means to accommodate the stack. In either instance of raising or lowering the stack, auxiliary equipment is required which is bulky and expensive.

Another design for the bundling of tires is to receive them in a horizontally stacked position as where the axis is horizontally extending. In these instances, it was proposed to automate the receiving of the tires, indexing them automatically into stacking condition and then provide automatic bundling machines to tie them into a unitary whole. The principle disadvantage of such automatic bundling machines is their enormous cost and that it is difficult to justify the cost of such a machine except on an automatic production line.

The present invention is directed to a bundling machine which costs one-tenth to one-twentieth of that of the above type machines. The present invention is designed to handle all sizes of tires with provision for bundling or strapping the stack of tires quickly and efficiently. The low cost of the present machine justifies its installation at locations where bundling of tires is done on an intermittent basis as well as at a production line run.

SUMMARY OF THE INVENTION

The present invention contemplates an apparatus which has a pair of vertically spaced tire compressing supports. Upon receiving the preselected number of tires, the stack is then compressed a predetermined amount and held in this condition until straps from a strap feeding unit encompasses the tires and is clinched to hold the stack of tires in their compressed condition. The strapping operation is facilitated by the rotation of the stacked tires to permit the placement of additional straps as necessary around the compressed tires at different locations.

DETAILED DESCRIPTION

Figure 1:
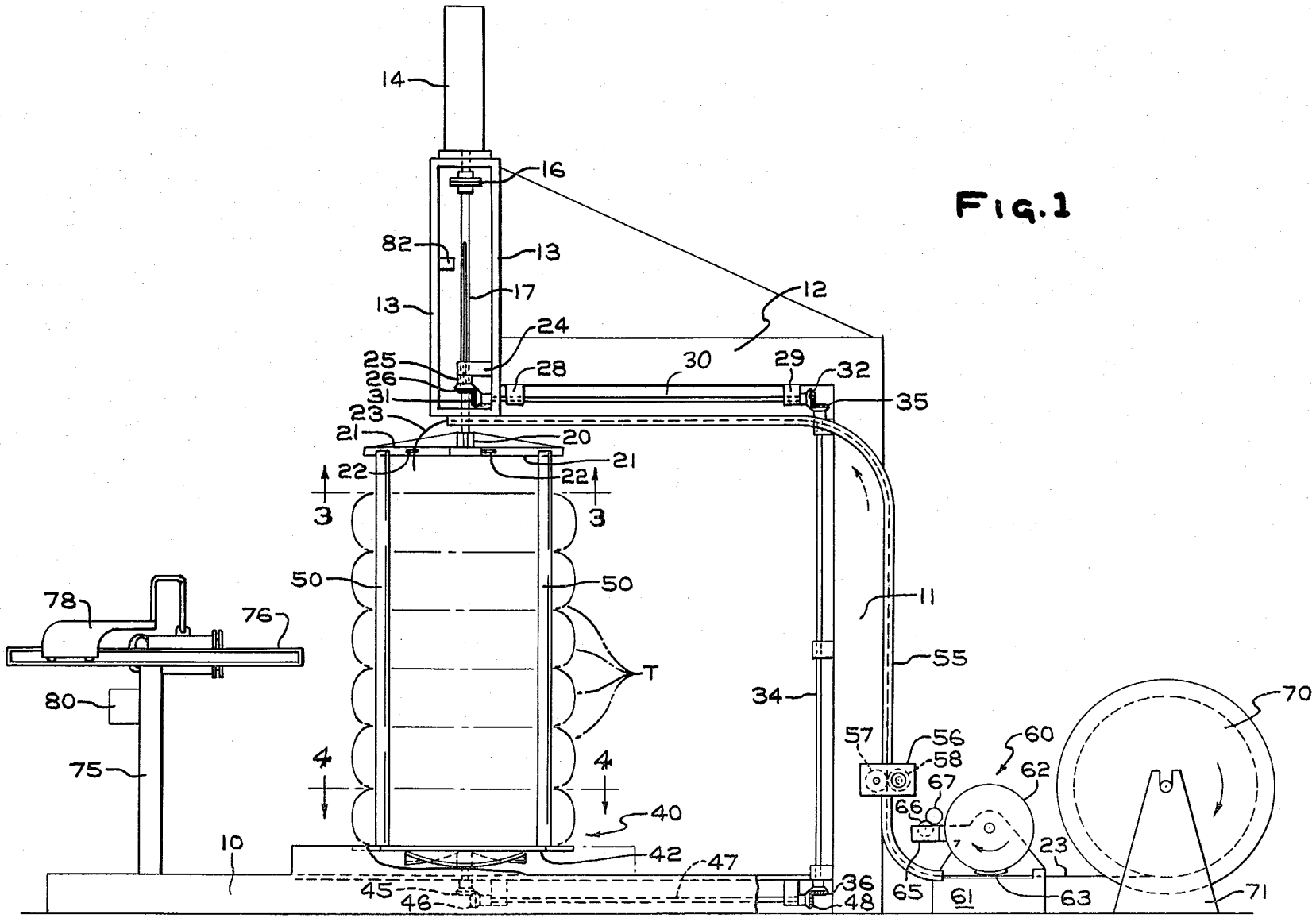
FIG. 1 is a side elevational view of a tire stacking and bundling machine prior to the compression of the tires.

Referring to the drawings wherein like reference numerals designate like or corresponding parts throughout the several views, there is shown in FIG. 1 a support base 10 having a column 11 secured to one end portion thereof. Mounted on the upper end portion of column 11 is a bracket or support member 12 with a pair of vertically extending support members 13 secured thereto. Support members 13 have a pneumatic cylinder 14 secured to an upper end plate that interconnects the supports 13. Cylinder 14 has its piston rod 15 extending downward between support members 13 and attached to a clutch member or means 16. Extending downwardly from clutch member 16 is a splined shaft 17 having its end portion secured to a hub 20. Extending radially outwardly from the hub 20 is a plurality of arm members or arms 21. Each arm member 21 has a hook 22 secured thereto for guiding a banding strap 23 therethrough. Hub 20 and the radially extending arm members 21 comprise an upper tire support member 19. A bracket 24 mounted between support members 13 supports a bushing 25 on which is journaled a bevel gear 26. Bevel gear 26 is internally splined to receive the splined shaft 17. Support member 12 has a pair of brackets 28 and 29 through which a shaft 30 is journaled. The respective end portions of shaft 30 have bevel gears 31 and 32 thereon, with bevel gear 31 meshing with gear 26. Column 11 has suitable bracket means for rotatably supporting shaft 34 which has bevel gears 35 and 36 thereon, with bevel gear 35 meshing with gear 32. Suitably journaled on base 10 is a lower tire support member 40, having a hub 41 and a plurality of radially extending arm members or arms 42. A disk 43 is attached to the underneath portion of the tire support member 40 and is contoured to deflect outwardly a downwardly projected strap that is used to bundle a stack of tires in a manner to be described. The base 10, column 11 and support member 12 along with the vertically extending support member 13 forms the support means or support framework for the bundling machine also referred to as the tire stacking and strapping machine.

Figure 2:
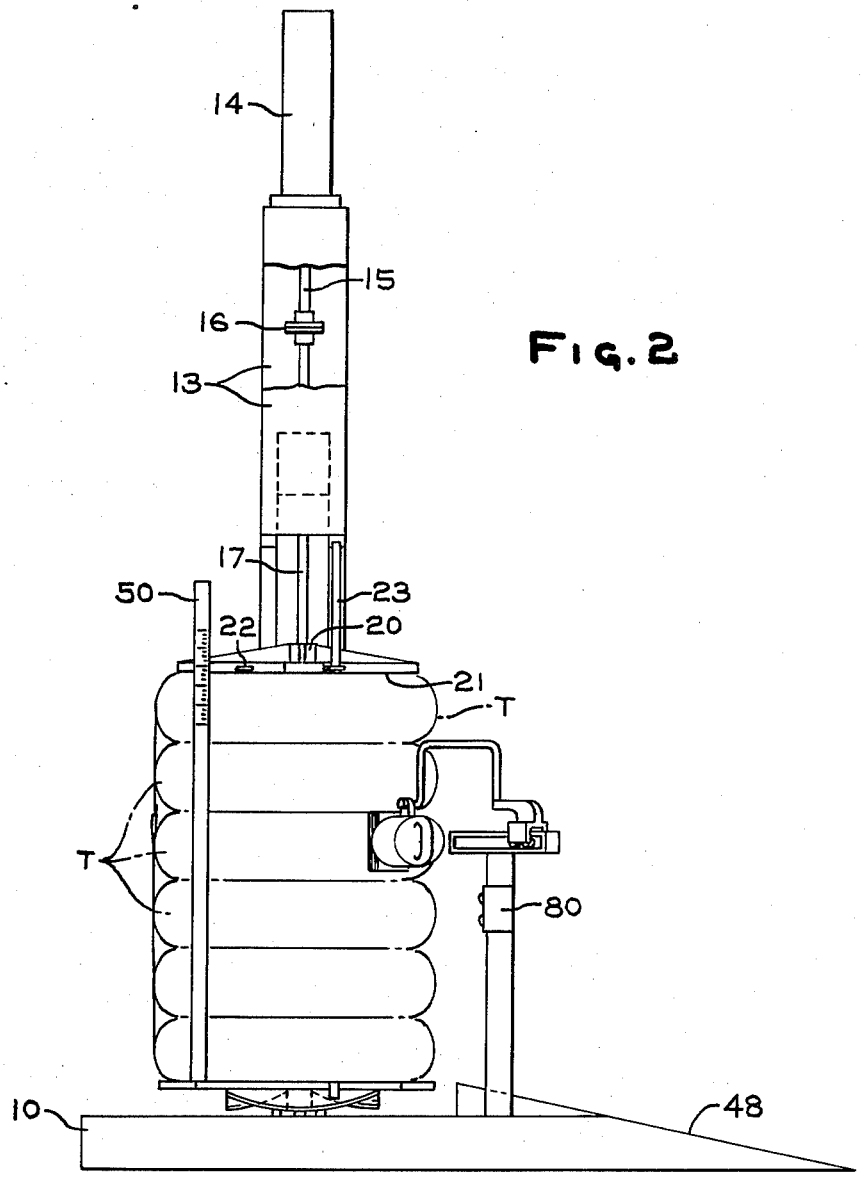
FIG. 2 is a front elevational view of the tire stacking and bundling machine showing the stack of tires compressed and having at least one complete strap encircling the stack of tires.
Figure 3:
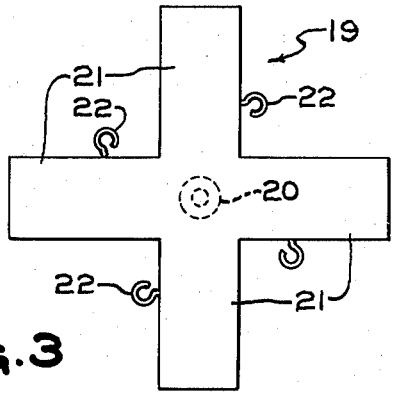
FIG. 3 is a plan view of the upper tire support and compressing means taken on line 3—3 of FIG. 1.
Figure 4:
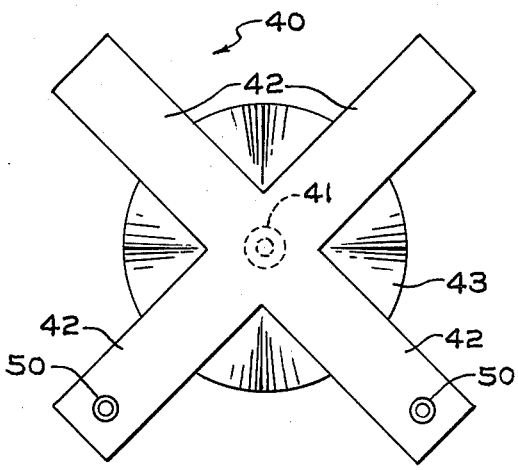
FIG. 4 is a plan view of the lower tire support means taken on line 4—4 of FIG. 1.

The lower tire support member 40 is keyed to a shaft having a bevel gear 45 thereon, which gear 45 meshes with a bevel gear 46. A shaft 47, suitably journaled in base 10 has the bevel gear 46 on one end and a bevel gear 48 on the other end to thereby complete a positive drive connection between the lower tire support member 40 and the upper tire support member 19. Mounted on the outboard ends of two of the radially extending arm members 42 are vertically extending guide bars 50. The pair of guide bars 50 provides a means for aligning the stack of tires T, as shown in FIGS. 1 and 2.

A chute 55 extending upwardly from the lower portion of column 11 also extends along support member 12, terminating adjacent to the center or hub 20 of upper tire support member 19. A housing 56 is suitably mounted at the lower end portion of chute 55, containing a pair of rollers 57–58, one suitably driven by a motor to feed the strap upward through the chute. Mounted adjacent to the chute 55 is an indicia marker 60, containing a base 61 on which is journaled for rotation a roller 62. Roller 62 has an indicia plate 63 which is adapted to contact the strap 23 as it passes underneath, traveling at the same rate of speed. Suitably connected to base 61 is an ink housing 65 containing a rotatable ink roller 66 and a roller 67. As indicia plate 63 comes in contact with roller 67, plate 63 picks up ink and is ready to imprint the strap 23 as it passes into contact therewith.

A strap storage reel 70 journaled on support 71 unwinds the strap material as it is pulled therefrom by the feed rollers 57 and 58.

A support member 75 mounted on base 10 supports a guide member 76 on which is journaled for reciprocal movement toward and away the stack of tires a strap clinching means 78 which clamps the free end of a length of strap or strapping 23 into a fixed position, thereafter it cooperates with a loop formed of the other end of the strap (from the upper end of the stack) which strap thereby encompasses the stack of tires. The strap clinching means 78 automatically tensions the straps into overlapping relationship, thence severs the loop end and secures by the clinching operation. These clinchers or strap clamping and severing tools are old and well known in the art and also referred to as a combination strapping tool, available commercially from the Signode Corporation, 2600 North Western Avenue, Chicago, Illinois 60647. Note the following U.S. Pat. Nos. 3,648,739; 3,552,450; 4,041,993 and 4,011,807 are incorporated herein by reference. The support member 75 supports a control box 80 which controls via suitable switches the actuation of the motor which controls the rollers 57–58 and the actuation of the cylinder 14 which controls the compression of the stack of tires.

In the operation of the described apparatus, tires are stacked onto the lower tire support member 40 until a predetermined number of tires are stacked. The vertical alignment of the tires is facilitated by the two vertically spaced guide bars 50. The operator via control box 80 actuates the head end of cylinder 14 which extends the piston rod and clutch 16 downwardly such that the upper tire support member 19 compresses the stack of tires to the desired height. This can be controlled by a suitable control valve in control box 80, by a predetermined pressure in cylinder 14 or by providing a suitable stop 82 which is adjustable on tubular support member 13. Indicia is provided on the guide bars 50 to provide a visual means to determine the extent of the compression that the tires are subjected to. The operator then actuates the drive motor via control box 80 to drive rollers 56, 57 which feeds the strap from reel 70 to chute 55. The strap emerges from chute 55 at approximately the top of the stack of tires and is guided downwardly through the center of the stack of tires by a suitable weight if necessary. The strap on striking the disk 43 which is beveled or tapered in its contour, emerges out from the stack of tires. The operator then slides the strap clinching device 78 along the guideways of the guide member 76 towards the stack of tires. The operator then secures the free end of the strap into the clincher 78. The slack end of the strap adjacent to the top of the chute 55 is pulled down as a loop, placed into the strap clincher device 78 to form a complete loop around the stacked tires. The strap clinching device 78 is then actuated, which tensions the strap loop about the tires, seals the strap and cuts off the excess portion of the strap. The strap clinching device 78 is then moved away from the stack of tires on the guideways of the guide member 76. The operator then rotates the stack of tires 90° with the respective upper and lower tire support members 19 and 40 rotating with the tires. A second encompassing strap is placed about the stack of tires and such stack is then rotated another 90°. A third and fourth strap may similarly be placed around the stack of tires, afterwhich the rod end of cylinder 14 is actuated to raise the upper tire support member 19 thus completing the bundling of the stack of tires. The base 10 may have an inclined ramp portion 84 to facilitate the discharge of the stack of tires.

Modifications are contemplated and may obviously be resorted to by those skilled in the art without departing from the described invention, as hereinafter defined by the appended claims, as only a preferred embodiment thereof has been disclosed.

I claim:

1. In an automotive tire bundling machine having a support framework, a pair of spaced rotatable tire support members journaled on said support framework for rotation, means for selectively moving one of said support members toward and away from the other one of said support members to compress a stack of tires therebetween, a strap feeding means for feeding a strap downwardly through a stack of tires held between said spaced tire support members, guide means mounted on said other one of said support members for aligning tires stacked on said last mentioned support member, and clinching means mounted adjacent to said support members for engaging a strap that encompasses said stacked tires for drawing and maintaining the peripheral area of adjacent tires in abutting contact.

2. In an automotive tire bundling machine as set forth in claim 1 wherein each of said tire support members has a plurality of radially extending arms for engaging spaced peripheral portions of the adjacent tire.

3. In an automotive tire stacking and strapping machine as set forth in claim 2 wherein said strap feeding means includes a storage strap reel, a chute for guiding strap to said stacked tires and drive means for feeding strap through said chute.

4. In an automotive tire bundling machine comprising support means, a rotatable lower tire support member journaled on said support means for rotation about a central axis, said lower tire support member operative to support tires stacked thereon, a rotatable upper tire support member journaled on said support means in alignment with said lower support member for engaging tires stacked therebetween, means interconnecting said support members for effecting simultaneous rotation of said tire support members on rotation of tires held therebetween, feed means mounted on said support means connected to said upper tire support member for moving said upper support member toward said lower support member to compress a stack of tires held between said tire support members, guide bars on said lower support member for aligning tires thereon, strap feeding means for feeding a strap to encompass said tires stacked and compressed between said tire support members, and strap clinching means mounted on said support means adjacent to said tire support members for securing said strap encompassing said stacked tires.

5. In an automotive tire bundling machine as set forth in claim 4 wherein each of said tire support members has a plurality of arms extending radially outwardly from the center thereof to engage a plurality of circumferentially spaced portions of an adjacent tire.

6. In an automotive tire bundling machine as set forth in claim 5 wherein said lower support member has a plurality of inclined chutes between adjacent arms to deflect outwardly said strap moved downwardly.

7. In an automotive tire bundling machine as set forth in claim 6 wherein a strap guide chute is mounted on said support means for guiding a strap from a feed source to a position adjacent said upper tire support member for movement downwardly axially through said stacked tires.

8. In an automotive tire bundling machine as set forth in claim 7 wherein said support members are interconnected by a plurality of shafts and bevel gears to maintain simultaneous rotation of said support member upon manual rotation thereof of any one of said support members.

9. In an automotive tire bundling machine as set forth in claim 8 wherein said strap feeding means includes a storage reel having strap thereon for feeding into said guide chute, and drive roller means connected to said strap adjacent to said chute for feeding strap into said chute and downwardly into said stacked tires.

10. In an automotive tire bundling machine as set forth in claim 9 wherein indicia stamping means is mounted adjacent to said storage reel operative for selectively marking said strap as it is fed from said storage reel to said drive roller means.

* * * * *